US006766132B2

(12) United States Patent
Sakai et al.

(10) Patent No.: US 6,766,132 B2
(45) Date of Patent: Jul. 20, 2004

(54) DEVELOPING DEVICE

(75) Inventors: Hiroaki Sakai, Shizuoka (JP); Takeshi Kawamura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/011,411

(22) Filed: Dec. 11, 2001

(65) Prior Publication Data

US 2002/0071694 A1 Jun. 13, 2002

(30) Foreign Application Priority Data

Dec. 12, 2000 (JP) ..... 2000-377396

(51) Int. Cl.[7] ..... G03G 15/08; G03G 15/04

(52) U.S. Cl. ..... 399/256; 399/119; 399/254; 399/260

(58) Field of Search ..... 399/119, 254, 399/256, 258, 260, 262, 263, 272

(56) References Cited

U.S. PATENT DOCUMENTS 5,077,583 A * 12/1991 Bhagat ..... 399/256 X
5,287,151 A * 2/1994 Sugiyama ..... 399/258
5,495,320 A * 2/1996 Araki et al. ..... 399/256
5,857,134 A * 1/1999 Ahn ..... 399/256
5,943,537 A * 8/1999 Ahn ..... 399/254
6,336,022 B2 * 1/2002 Ichikawa et al. ..... 399/254

FOREIGN PATENT DOCUMENTS

| | | | |
|---|---|---|---|
| JP | 3-172873 | | 7/1991 |
| JP | 4-115268 | | 4/1992 |
| JP | 04-115269 | * | 4/1992 |
| JP | 08-0629958 | * | 3/1996 |

* cited by examiner

*Primary Examiner*—Sandra L Brase
(74) *Attorney, Agent, or Firm*—Fitzpatrick, Cella, Harper & Scinto

(57) ABSTRACT

A developing device includes a developer bearing member and a developer container for containing a developer therein. The developer container has a plurality of developer containing rooms (chambers) provided with developer conveyers for conveying the developer toward the developer bearing member. The rotational speed of the developer conveyor in the room nearest to the developer bearing member is higher than that of the developer conveyers in the other rooms, or the volume of the room nearest to the developer bearing member is smaller than that of the other rooms, or the thickness of the developer conveyer in the room nearest to the developer bearing member is smaller than that of the developer conveyers in the other rooms, or the Young's modulus of the developer conveyor in the room nearest to the developer bearing member is smaller than that of the developer conveyers in the other rooms.

23 Claims, 11 Drawing Sheets

FIG. 7

RELATIONSHIP BETWEEN AGITATING ROTATION NUMBER AND CONVEYABILITY OF TONER

| | | AGITATING ROTATION NUMBER [rpm] | | | | | |
|---|---|---|---|---|---|---|---|
| | | 1 | 3 | 5 | 10 | 20 | 30 |
| AGITATING MEMBER | 17a | × | △ | ○ | ○ | ○ | ○ |
| | 17b | ○ | ○ | ○ | ○ | ○ | ○ |
| | 17c | ○ | ○ | ○ | ○ | ○ | ○ |

○ : FAIR △ : SLIGHTLY SHORT × : SHORT

TONER CONVEYABILITY BASED ON RELATIONSHIP BETWEEN RADIUS OF GYRATION AND AGITATING SHEET THICKNESS

| | | AGITATING SHEET THICKNESS [μm] | |
|---|---|---|---|
| | | 50 | 100 |
| RADIUS OF GYRATION [mm] | 20 | × | ○ |
| | 30 | ○ | ○ |

○ : FAIR × : SHORT

DEFORMATION BASED ON RELATIONSHIP BETWEEN AGITATING SHEET THICKNESS AND RADIUS OF GYRATION

| | | AGITATING SHEET THICKNESS [μm] | |
|---|---|---|---|
| | | 50 | 100 |
| RADIUS OF GYRATION [rpm] | 2 |  |  |
| | 5 |  |  |
| | 10 |  |  |

COMPARISON OF THE AMOUNT OF DEVELOPER BASED ON THE DEFERENCE BETWEEN WITH OR WITHOUT PARTITION MEMBER

DEVELOPING DEVICE

BACKGROUND OF THE INVENTION

1. Field of the Invention

This invention relates to a developing device mounted on an image forming apparatus such as a copier or a laser beam printer adopting the electrophotographic process.

2. Description of Related Art

In an electrophotographic image forming apparatus using the electrophotographic image forming process, there has heretofore been adopted a process cartridge system in which an electrophotographic photosensitive drum and process means for acting on the electrophotographic photosensitive drum are integrally made into a cartridge which is detachably mountable on the main body of the image forming apparatus. According to this process cartridge system, a user himself can effect the maintenance of the apparatus without resort to a serviceman and therefore, operability could be markedly improved. So, this process cartridge system is widely used in electrophotographic image forming apparatuses.

A process cartridge comprises at least developing means and a photosensitive drum integrally made into a cartridge detachably mountable on the main body of an image forming apparatus, and there is also a process cartridge further comprising a developer container, charging means, cleaning means, etc. constructed integrally with one another.

FIG. 16 of the accompanying drawings illustrates an image forming apparatus according to the prior art. In FIG. 16, a process cartridge 100 comprises a photosensitive drum 101 which is an image bearing member, a developing device 103, a cleaning device 105, a charging member 106 and a toner container 109 which is a developer container, all being constructed integrally with each other. The image forming apparatus also has an exposing device 102, a transferring device 104, a fixing device 107 and a feeding device 108.

The exposing device 102 applies a laser beam L conforming to image information to the surface of the photosensitive drum 101 charged to predetermined potential by the charging member 106, and eliminates charges therefrom to thereby form an electrostatic latent image on the photosensitive drum 101.

An agitating member 110 is provided in the toner container 109, and prevents the coagulation of a developer (hereinafter referred to as the toner) and also carries the toner to the developing device 103. The developing device 103 develops the electrostatic latent image on the photosensitive drum 101 by a developing sleeve 111 to thereby form a toner image. The formed toner image is transferred to the surface of a transferring material fed by the feeding device 108, and is heated and pressurized by the fixing device 107, whereby it is permanently fixed, and the transferring material is discharged out of the apparatus. On the other hand, any toner, paper dust, etc. residual on the photosensitive drum 101 after the transfer are removed by the cleaning device 105.

Now, with the higher speed of the image forming apparatus in recent years, the higher-speed countermeasure and higher durability of the process cartridge 100 have been required and therefore, the amount of toner filling a process cartridge 100 has become great and the toner container 109 itself also has become large. However, the increase in the amount of filling toner gives rise to the problem that in the conventional container construction, the rising time of the toner (reaching a predetermined charging amount necessary for development) becomes long, that is, much time is required until a proper amount of development is reached.

As shown in FIG. 17 of the accompanying drawings, the toner in the toner container 109 is charged by contacting with the developing sleeve 111, and any toner which has not been used for development returns into the toner container 109. When the amount of filling toner becomes great, the occasion on which the toner in the toner container 109 contacts with the developing sleeve 111 decreases and therefore, much time is required until all the toner in the toner container 109 reaches a predetermined charging amount.

FIG. 18 of the accompanying drawings shows the relationship between the number of formed images and the amount of toner used for development (the amount of development per unit time: M/S: mass/sheet, unit mg/cm$^2$) when the toner container is filled with 1500 g of toner to ensure, for example, recording of 30,000 sheets. As shown, when the conventional construction of the toner container 109 was filled with 1500 g of toner, 15,000 sheets of image formation were required until a proper amount of development was reached. At this time, the toner in the process cartridge 100 circulates greatly in the toner container 109, as shown in FIG. 17.

SUMMARY OF THE INVENTION

The present invention has been made in view of the above-noted problems and an object thereof is to provide a developing device which is stable in its developing characteristic from the initial stage of use.

Another object of the present invention is to provide a developing device of large capacity which is excellent in its developing characteristic.

Still another object of the present invention is to provide a developing device comprising:

a developer bearing member; and a developer container for containing a developer therein, the developer container having a plurality of developer containing rooms (chambers) provided with developer conveyers for conveying the developer toward the developer bearing member;

wherein the rotational speed of the developer conveyer in the room (chamber) nearest to the developer bearing member is higher than that of the developer conveyers in the other rooms (chambers).

Yet still another object of the present invention is to provide a developing device comprising:

a developer bearing member; and a developer container for containing a developer therein, the developer container having a plurality of developer containing rooms (chambers) provided with developer conveyers for conveying the developer toward the developer bearing member;

wherein the volume of the room (chamber) nearest to the developer bearing member is smaller than that of the other rooms (chambers).

a further object of the present invention is to provide a developing device comprising:

a developer bearing member; and a developer container for containing a developer therein, the developer container having a plurality of developer containing rooms (chambers) provided with sheet-shaped developer conveyers for conveying the developer toward the developer bearing member;

wherein the thickness of the developer conveyer in the room (chamber) nearest to the developer bearing member is smaller than that of the developer conveyers in the other rooms (chambers).

Still a further object of the present invention is to provide a developing device comprising:

a developer bearing member; and a developer container containing a developer therein, the developer container having a plurality of developer containing rooms (chambers) provided with sheet-shaped developer conveyers for conveying the developer toward the developer bearing member;

wherein the Young's modulus of the developer conveyer in the room (chamber) nearest to the developer bearing member is smaller than that of the developer conveyers in the other rooms (chambers).

Further objects of the present invention will become apparent from the following detailed description when read with reference to the accompanying drawings.

BRIEF DESCRIPTION OF THE DRAWINGS

FIG. 7 illustrates the amount of toner supply for the number of rotations of each agitating member.

DESCRIPTION OF THE PREFERRED EMBODIMENTS

First Embodiment

Figure 1:
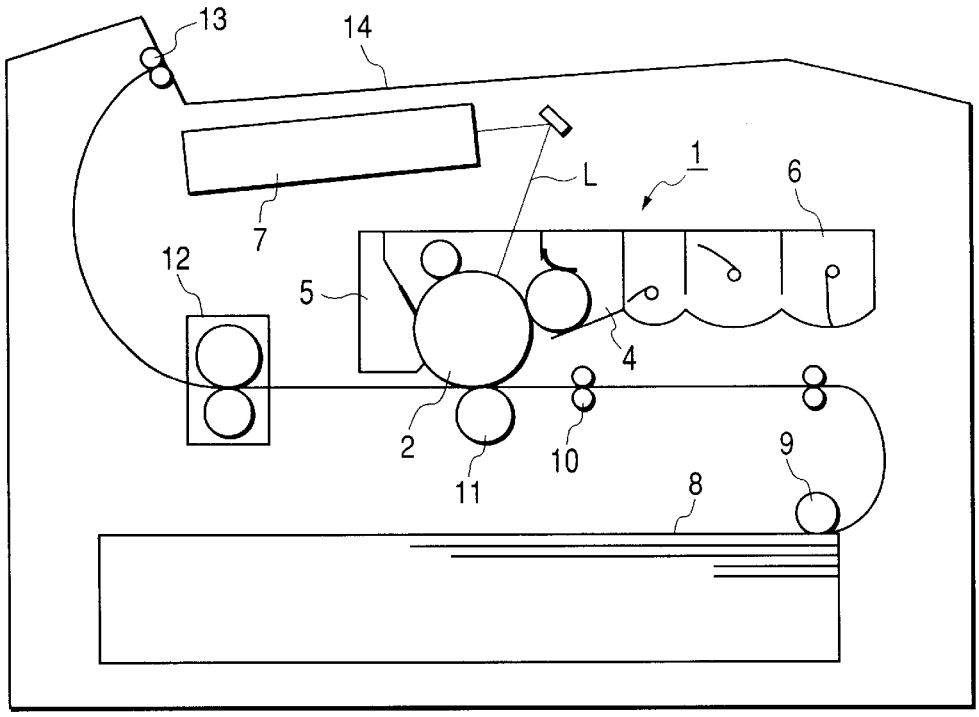
FIG. 1 shows the general construction of an image forming apparatus.
Figure 2:
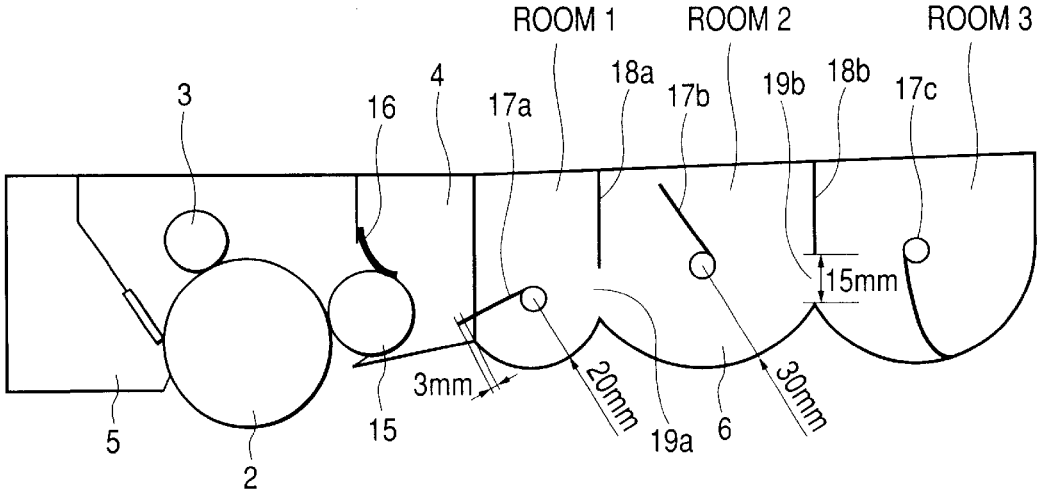
FIG. 2 shows the construction of a process cartridge.
Figure 3:
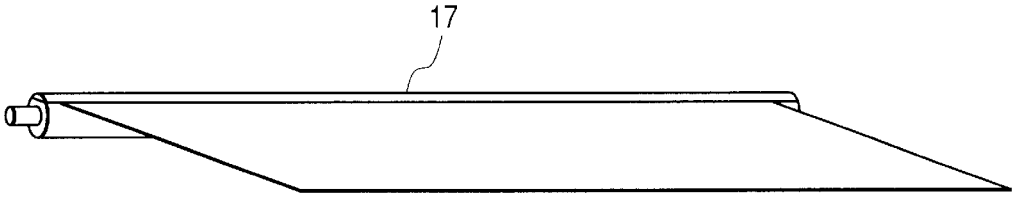
FIG. 3 is a perspective view of an agitating member.
Figure 4:
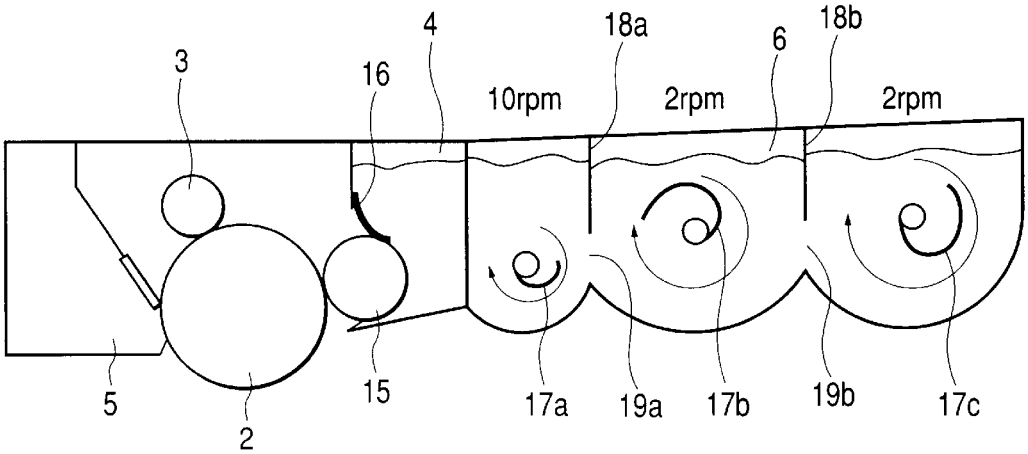
FIG. 4 illustrates the operation of the agitating member.
Figure 5:
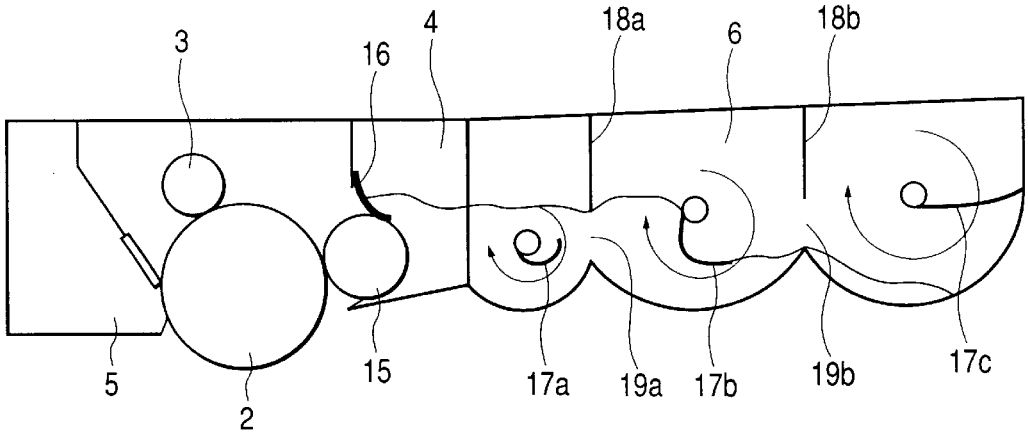
FIG. 5 illustrates the operation of the agitating member.
Figure 6:
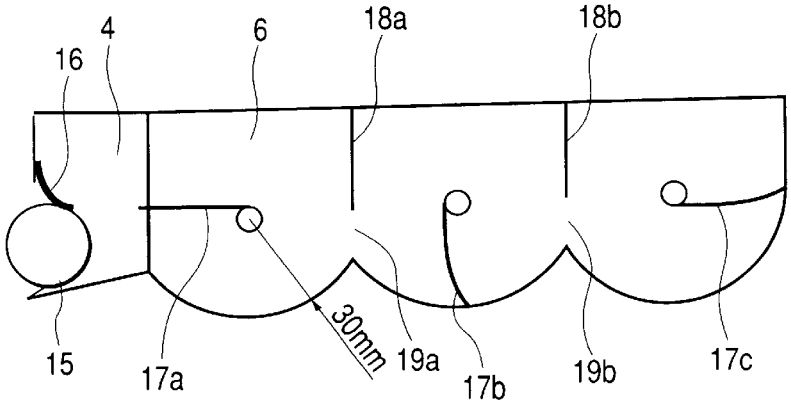
FIG. 6 is a cross-sectional view of a developing device used in a specific example.
Figures 8, 9:
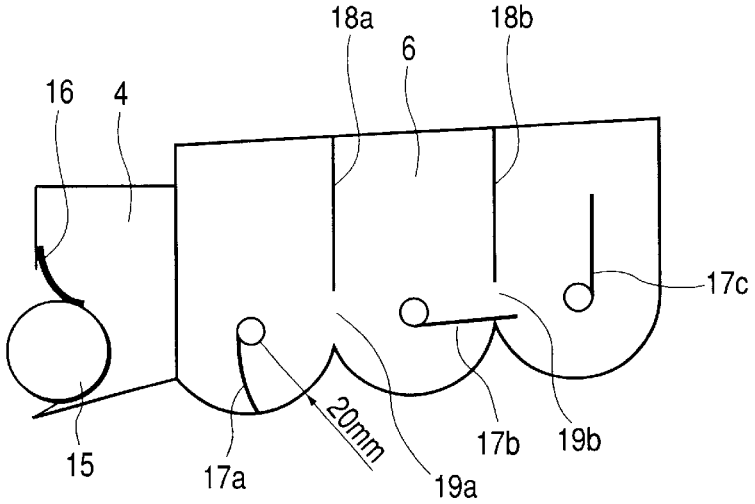
FIG. 8 is a cross-sectional view of a developing device used in a specific example.
FIG. 9 illustrates the toner conveyability based on the relationship between the radius of gyration and thickness of the agitating member.
Figure 10:
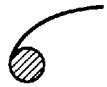
FIG. 10 illustrates the amount of deformation based on the relationship between the thickness and number of rotations of the agitating member.
Figure 10:
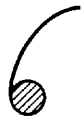
Figure 10:
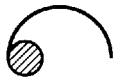
Figure 10:
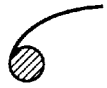
Figure 10:
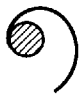
Figure 10:
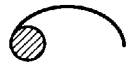
Figure 11:
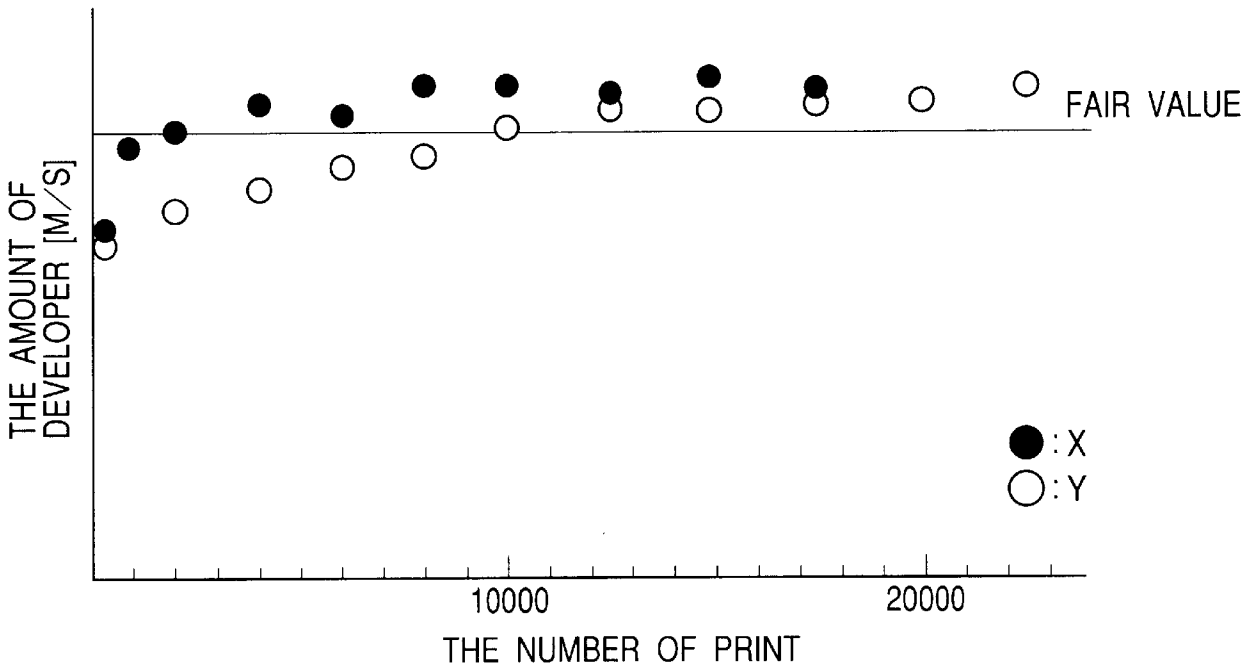
FIG. 11 illustrates the comparison of the amounts of developer based on the difference between the presence and absence of a partition member.

A first embodiment of a developer container, a process cartridge and an image forming apparatus according to the present invention will hereinafter be described with reference to the drawings. FIG. 1 shows the general construction of the image forming apparatus, FIG. 2 shows the construction of a process cartridge, FIG. 3 is a perspective view of an agitating member, FIGS. 4 and 5 illustrate the operation of the agitating member, FIG. 6 is a cross-sectional view of a developing device used in a specific example, FIG. 7 illustrates the amount of toner supply for the number of rotations of each agitating member, FIG. 8 is a cross-sectional view of a developing device used in a specific example, FIG. 9 illustrates the toner conveyability based on the relationship between the radius of gyration and thickness of the agitating member, FIG. 10 illustrates the amount of deformation based on the relationship between the thickness and number of rotations of the agitating member, and FIG. 11 illustrates the comparison of the amounts of developer based on the difference between the presence and absence of a partition member.

Reference is first had to FIG. 1 to describe the entire image forming apparatus. In FIG. 1, the process cartridge 1 comprises a photosensitive drum 2 which is an image bearing member, a charging member 3, a developing device 4, a cleaning device 5 and a toner container 6 which is a developer container, all being constructed integrally with one another. The image forming apparatus also has an exposing device 7, a feeding device 8, a transferring device 11, a fixing device 12, etc.

In case of image formation, the photosensitive drum 2 is first uniformly charged to predetermined potential by the charging member 3, and the exposing device 7 applies a laser beam L conforming to image information to the surface of the photosensitive drum to thereby eliminate charges therefrom and form an electrostatic latent image. The electrostatic latent image is visualized by being developed by the developing device 4, and a toner image is formed on the photosensitive drum 2.

The feeding device 8 is disposed in the lower portion of the apparatus, and transferring materials contained therein are separated and fed one by one by a feed roller 9 and have their skew feeding corrected by a pair of registration rollers 10 and also are conveyed in synchronism with the toner image. The toner image on the photosensitive drum 2 is then transferred to the transferring material by the transferring device 11, and has heat and pressure applied thereto by the fixing device 12, whereby it is permanently fixed, whereafter the transferring material is discharged onto a discharge tray 14 outside the apparatus by a pair of discharge rollers 13, thus terminating image formation. Any toner, paper dust, etc. residual on the photosensitive drum 2 after the transfer are removed by the cleaning device 5, and the photosensitive drum 2 is used for the next image formation.

As shown in FIG. 2, the process cartridge 1 comprises the photosensitive drum 2, the charging member 3, the developing device 4, the cleaning device 5 and the toner container 6 constructed integrally with one another. The developing device 4 has a developing sleeve (developer bearing member) 15 disposed in proximity to the photosensitive drum 2, and a doctor blade 16 abuts against this developing sleeve 15. The developing sleeve 15 used comprises an aluminum mandrel provided with a carbon coat. A magnet, not shown, is provided in this developing sleeve 15 to thereby attract a black toner containing magnetite onto the developing sleeve 15, and the toner is uniformly applied onto the developing sleeve by the doctor blade.

The bottom surfaced of the toner container 6 has three arcuate portions, and in the toner container 6, there are three agitating members (developer conveyers) 17*a*, 17*b*, 17*c*, rotated while abutting against the respective arcuate portions. Also, the toner container 6 is compartmentalized into three chambers by plate-shaped partition members 18*a* and a 18*b*. Openings 19*a* and 19*b* for the toner to move therethrough are formed between the partition members 18*a* and 18*b* and the bottom surface of the toner container, and the height of each of these openings is 15 mm, and the openings are provided over the width (a direction perpendicular to the plane of the drawing sheet of FIG. 1) of the toner container 6. Also, during the non-use of the toner, these openings 19*a* and 19*b* are at such a height that they are buried in the toner.

By setting thus, the amount of circulation of the toner can be made small. On the other hand, if the openings 19*a* and 19*b* are made to small, a hindrance will occur to the conveyability of the toner and therefore, the above-described setting takes the circularity and conveyability of the toner into account. The toner container 6 according to the present embodiment is one of a large capacity capable of being filled with 1500 g of toner and enabling the image formation of 30,000 sheets to be effected at a print rate of 4%.

As described above, the toner container 6 has three rooms (chambers) having the agitating members therein. The rooms (chambers) are hereinafter referred to as room 1, room 2 and room 3.

In the unused state of the cartridge, the room 1 and the room holding the developing sleeve 15 therein are completely partitioned by a film-like seal. When the cartridge begins to be used, this film-like seal is torn off and a large opening appears between the room 1 and the room holding the developing sleeve 15 therein. Accordingly, after the film-like seal has been torn off, the sleeve 15 can be regarded as being in the room 1.

As shown in FIGS. 2 and 3, each agitating member 17 is of a construction in which a sheet material is provided on an agitating shaft, and in the present embodiment, the agitating member 17*a* adopts a PPS (polyphenylene sulfide) sheet having a thickness of 50 $\mu$m (Young's modulus: 3 GPa (Giga Pascal)), and is rotated with a radius of gyration of 20 mm and at a speed of 10 rpm (revolutions per minute). Also, the agitating member 17*b* and 17*c* adopt PPS sheets having a thickness of 100 $\mu$m (Young's modulus: 3 GPa), and are rotated with a radius of gyration of 30 mm and at a speed of 2 rpm. Also, each PPS sheet abuts against the container with an amount of entry of 3 mm. The agitating member 17*a* is thinner and higher in rotational speed than the agitating members 17*b* and 17*c* and therefore, when these agitating members are rotated at the beginning of the use of the cartridge, the amount of deformation of the agitating member 17*a* is greatest.

As shown in FIG. 4, the agitating members 17*a*–17*c* in a state in which the toner container is filled with 1500 g of toner (when the toner is not yet used) are elastically deformed by the load of the toner, and the toner circulates in each agitating area. The partition members 18*a* and 18*b* are provided as described above to thereby form small agitating areas, whereby the amount of toner moving between the agitating areas (rooms) decreases greatly. Also, in the agitating area (room 1) nearest to the developing sleeve 15, there is no great movement of the toner and therefore, the frequency of contact between the toner present near the developing sleeve 15 and the developing sleeve 15 increases and the charged state of the toner can be early approximated to a proper state.

Also, when the toner is consumed and the remaining amount of it becomes small, the agitating members 17*b* and 17*c* successively convey the toner toward the developing sleeve 15, as shown in FIG. 5. In the present embodiment, the PPS sheets are adopted as a material which does not cause a creep phenomenon even in the deformation in a state in which the toner container is sufficiently filled with the toner and therefore, in a state in which the toner has been decreased, the toner sufficiently reaches the bottom of the toner container 6 and sufficient toner conveyability can be secured until the last of the toner.

By the thickness of the sheet of the agitating member 17*a* nearest to the developing sleeve 15 being thus made smaller than that of the other agitating members 17*b* and 17*c*, the agitating member 17*a* is elastically deformed by the rotation thereof in a state in which the toner is sufficiently present, and the agitating action decreases and also, small circulation of the toner is formed around the agitating member 17*a*. By the number of rotations of the agitating member 17*a* being made greater than that of the other agitating members 17*b* and 17*c*, the supply of the toner can be sufficiently effected in a state in which the toner has been decreased. Further, by the volume of the room 1 provided with the agitating member 17*a* being made smaller than that of the other rooms 2 and 3, the agitating area formed by the agitating member 17*a* can be made small, and it becomes possible to quicken the rising of the toner. The volume of the room 1 can be made greater by tearing off the aforementioned film-like seal.

Also, by the number of gyrations of the agitating members 17*b* and 17*c* being made smaller than the number of gyrations of the agitating member 17*a* nearest to the developing device 4, the agitating capability can be reduced. Also, by the thickness of the sheets of the agitating members 17*b* and 17*c* being made greater than that of the agitating member 17*a*, reliable conveying ability can be secured even in a state in which the toner has been decreased.

The relationships between the number of rotations, radius of gyration and thickness of the agitating member and the toner conveying capability will now be shown.

The relationship between the number of rotations of the agitating member 17 and the conveyability of the toner was first examined. In the construction of the toner container 6 shown in FIG. 6, for comparison's sake, PPS sheets having a thickness of 100 $\mu$m are used as all agitating members 17*a*–17*c*, and the radius of gyration thereof is 30 mm and an amount of entry of 3 mm relative to the container is given to the agitating members. Images were solid black greatest in toner consumption, and when continuous image formation was effected at a speed of 50 sheets per minute, a result as shown in FIG. 7 was obtained. In FIG. 7, the amount of supply relative to the amount of development was judged thus:

○: fair; Δ: slightly short; x: short.

From this, it has been found that for the agitating member 17*a* nearest to the developing sleeve 15 to supply sufficient toner, a number of rotations of at least 5 rpm is necessary, and as to the agitating members 17*b* and 17*c*, particularly no inconvenience occurred between 1 rpm to 30 rpm.

The above-described result, however, is merely a result obtained by examining the toner conveying capability of each agitating member. When the rotational speed of the agitating members 17*b* and 17*c* becomes greater than that of the agitating member 17*a*, the amount of toner supply from the rooms 2 and 3 into the room 1 becomes excessive and the amount of toner in the room 1 becomes too great. Therefore, the toner coheres in the room 1 and becomes deteriorated. Accordingly, it is preferable that the rotational speed of the agitating members 17*b* and 17*c* be lower than that of the agitating member 17*a*.

Next, the conveyability of the toner based on the relationship between the radius of gyration of the agitating member 17 and the thickness of the sheet was examined. As the result of the comparison made by the use of a toner container 6 as shown in FIG. 6 wherein the radius of gyration of the agitating member 17*a* is 30 mm and a toner container 6 as shown in FIG. 8 wherein the radius of gyration of the agitating member 17*a* is 20 mm, there was obtained a result as shown in FIG. 9. As shown in FIG. 9, a PPS sheet having a radius of gyration of 30 mm and a thickness of 50 μm was weak in the elasticity of the sheet and the conveyability of the toner was not obtained, whereas by using a radius of gyration of 20 mm, sufficient conveyability could be obtained even for a PPS sheet having a thickness of 50 μm.

Also, it is necessary for the agitating member 17 to contact with the arcuate portion and reliably convey the toner to the developing sleeve 15 when the amount of toner in the toner container has become small. Accordingly, if the radius of gyration of the agitating member 17*a* is made small, it is necessary to make the radius of the arcuate portion of the room 1 small. This means that the volume of the room 1 becomes small. Consequently, the condition for securing the stability of images from immediately after the beginning of the use of the cartridge, i.e., the condition necessary to quickly raise the charging amount of the toner to a charging amount suited for development (the amount of toner in the room wherein the developing sleeve 15 is disposed in small), is also satisfied. Accordingly, it is preferable that the volume of the room 1 be smaller than that of the rooms 2 and 3.

Next, the amount of deformation based on the relationship between the thickness of the sheet and the number of rotations of the agitating member 17 is modelled and shown in FIG. 10. As shown in FIG. 10, the smaller is the thickness and the greater is the number of rotations, the more is flexed and rotated the sheet so as to twine around the shaft and therefore, the capability of agitating the toner lowers.

So, when in a construction wherein the thickness of the sheet is 50 μm, the radius of gyration is 30 mm and the number of rotations is 10 rpm, the toner container was filled with 1000 g of toner and the amount of development was compared between the presence (●X) and the absence (0: Y) of the partition members 18*a* and 18*b*, there was obtained a result as shown in FIG. 11. As shown in FIG. 11, it could be confirmed that by adopting a construction in which even when the toner container 6 is filled with a great amount of toner, the toner near the developing sleeve 15 does not move as far as possible, a sufficient developing property could be obtained as when the toner container was filled with about 500 g of toner. Also, in the construction of the toner container 6 shown in FIG. 8, an experiment was carried out with the container filled with 1000 g of toner and therefore, even in the absence of the partition members, a fair amount of development was reached for 10,000 sheets, and the relationship between the amount of filling toner and the rising of the developer could be confirmed.

As described above, by dividing the toner container 6 (developer container) into a plurality of agitating areas (developer containing portions), there can be provided such toner calculation that a toner container 6 containing a small amount of toner therein is connected to the developing device 4. Also, by constructing the agitating member 17 of a sheet material, it is possible to make the agitating action small when the amount of toner is great, and the toner near the developing device 4 rises quickly and therefore, it is possible to obtain a predetermined amount of development from the initial stage of the use of the cartridge 1. Also, the toner container 6 becomes laterally long when the above-described construction is realized and therefore, even when the weight load of the toner decreases and the fluidity of the toner lowers under a high-temperature high-humidity environment, the toner agitating capability and conveying capability do not lower and it becomes possible to maintain a good developing property.

Second Embodiment

Figure 12:
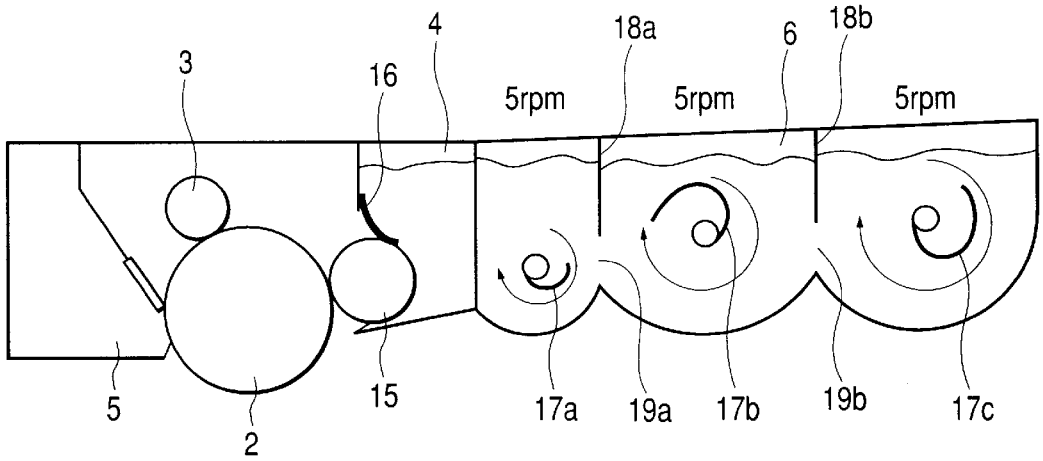
FIG. 12 shows the construction of a process cartridge according to a second embodiment.

A second embodiment of the developer container, the process cartridge and the image forming apparatus according to the present invention will now be described with reference to FIG. 12. In FIG. 12 which shows the construction of the process cartridge according to the present embodiment, portions overlapping those in the above-described first embodiment are given the same reference characters and need not be described.

While in the first embodiment, the agitating members 17*a*–17*c* are constructed as 10 rpm, 2 rpm and 2 rpm in the named order, in the present embodiment, all of them are constructed as 5prm. On the other hand, while in the first embodiment, the Young's moduli of the agitating members 17*a*–17*c* are all 3 GPa, in the present embodiment, the thicknesses of the three agitating members 17*a*, 17*b* and 17*c* are the same and the Young's modulus of the agitating member 17*a* is 1 Gpa and the Young's modulus of the agitating members 17*b* and 17*c* is 3 GPa.

By constructing so, even at the same number of rotations, the agitating member 17*a* nearest to the developing sleeve 15 becomes greater in the amount of flexure than the other agitating members 17*b* and 17*c* and the circulation of the toner near the developing sleeve 15 becomes small. Accordingly, the agitating capability near the developing sleeve 15 lowers and the circulation of the toner becomes small and therefore, the rising of the toner near the developing sleeve 15 becomes quick and a good developing property can be realized even at the initial stage of the use of the process cartridge 1. Also, by the numbers of rotations of the agitating members 17*a*–17*c* being of the same value, deceleration is not necessary and it becomes possible to construct agitating drive simply.

Third Embodiment

Figure 13:
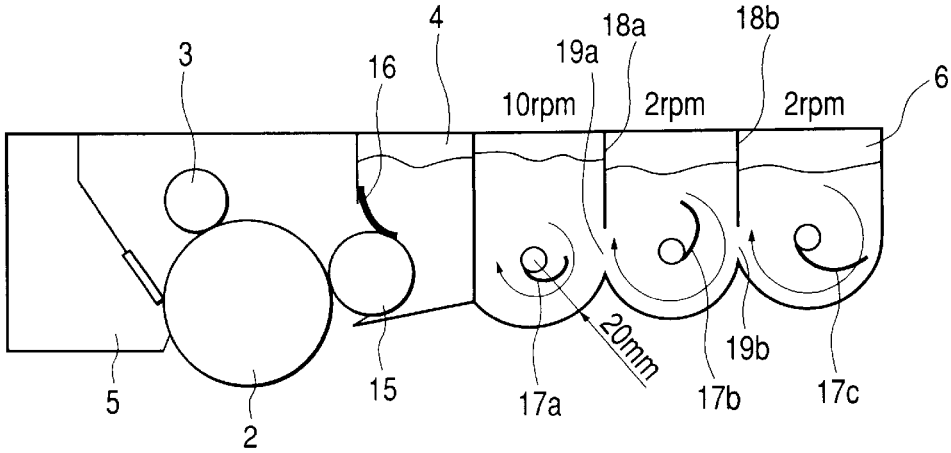
FIG. 13 shows the construction of a process cartridge according to a third embodiment.

A third embodiment of the developer container, the process cartridge and the image forming apparatus according to the present invention will now be described with reference to FIG. 13. In FIG. 13 which shows the construction of the process cartridge according to the present embodiment, portions overlapping those in the above-described first embodiment are given the same reference characters and need not be described.

The process cartridge 1 according to the present embodiment can be filled with 10000 g of toner and enables image formation of 20,000 sheets to be effected at a print rate of 4%. In the present embodiment, the agitating members 17*a*–17*c* all have the same thickness and the same radius of gyration, and the number of rotations of the agitating member 17*a* is 10 rpm, and the number of rotations of the agitating members is 2 rpm.

By constructing so, even when the same agitating members 17 are used, the amount of flexure becomes great and the circulation of the toner near the developing sleeve 15 becomes small because the number of rotations of the agitating member 17*a* is great. Accordingly, the agitating capability near the developing sleeve 15 lowers and the circulation of the toner becomes small and therefore, the rising of the toner near the developing sleeve 15 becomes quick and a good developing property can be realized even at the initial stage of the use of the process cartridge 1. Also, by making members constituting the agitating members 17*a*–17*c* common, it is possible to achieve a reduction in production cost.

Fourth Embodiment

Figure 14:
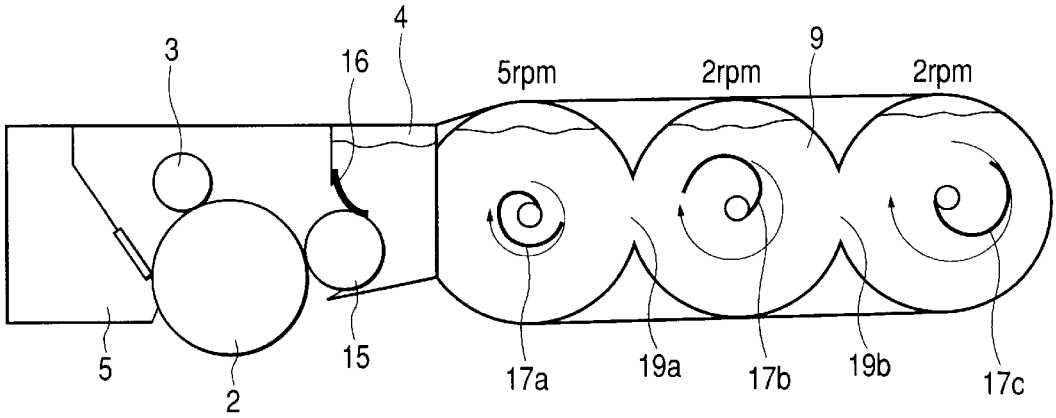
FIG. 14 shows the construction of a process cartridge according to a fourth embodiment.

A fourth embodiment of the developer container, the process cartridge and the image forming apparatus according to the present invention will now be described with reference to FIG. 14. In FIG. 14 which shows the construction of the process cartridge according to the present embodiment, portions overlapping those in the above-described first embodiment are given the same reference characters and need not be described.

While in the first embodiment, the agitating areas have been shown as being formed by the partition members 18*a* and 18*b*, in the present embodiment, there is adopted a construction in which cylinder-shaped containers are connected together, whereby agitating areas corresponding to the respective agitating members 17*a*–17*c* are formed. Again in the present embodiment, the agitating areas are connected together by openings of 15 mm being formed, and the construction and the number of rotations of each agitating member are similar to those in the first embodiment. The inner diameter of the cylinders and the construction, the number of rotations, etc. of the agitating members can be arbitrarily set depending on the amount of filling toner and the image forming speed.

Fifth Embodiment

Figure 15:
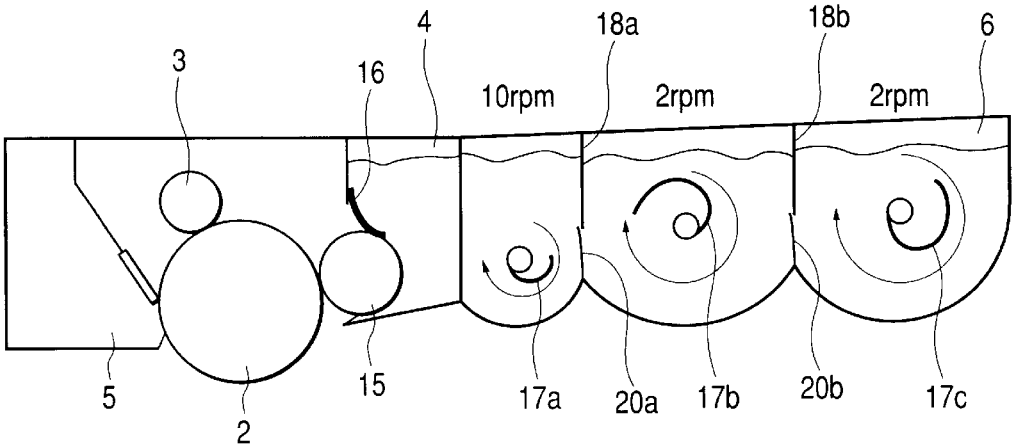
FIG. 15 shows the construction of a process cartridge according to a fifth embodiment.
Figure 16:
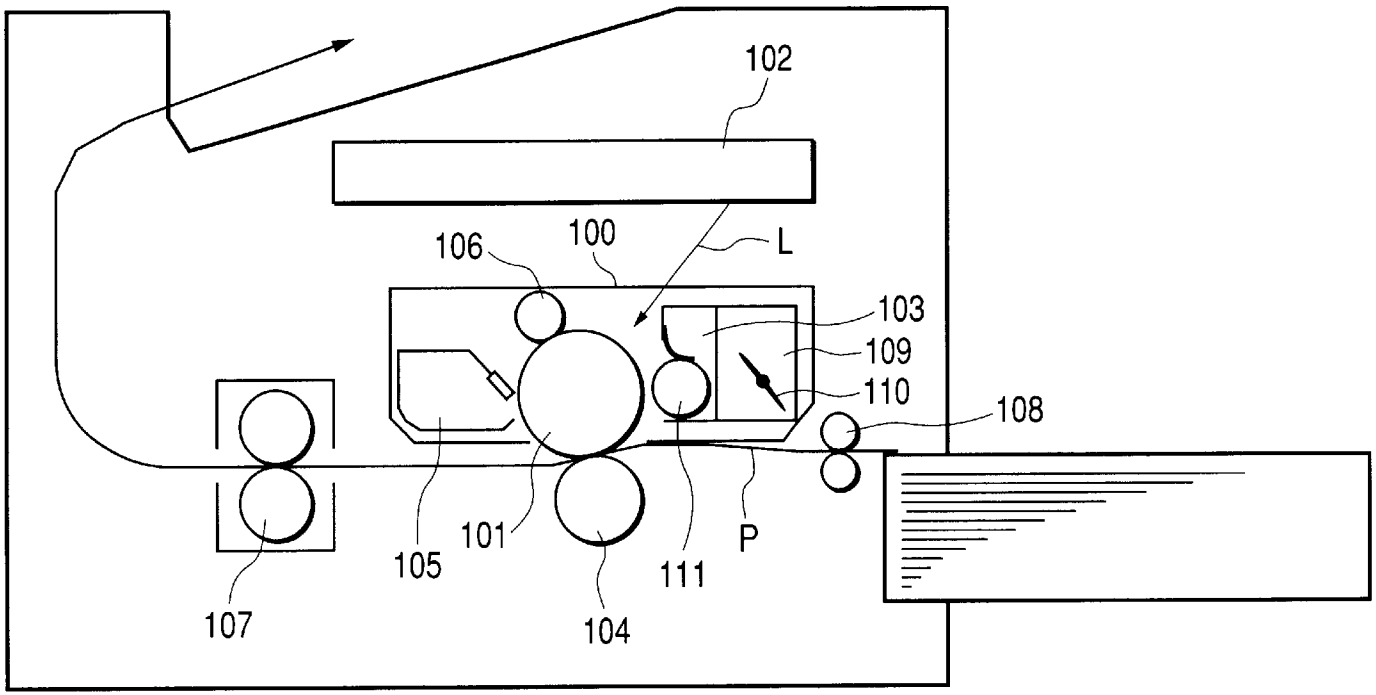
FIG. 16 illustrates an image forming apparatus according to the prior art.
Figure 17:
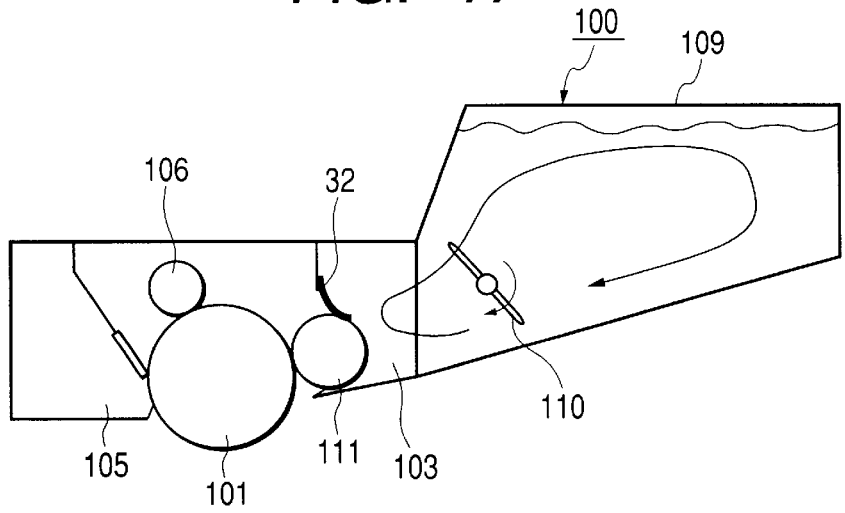
FIG. 17 shows the construction of a process cartridge according to the prior art.
Figure 18:
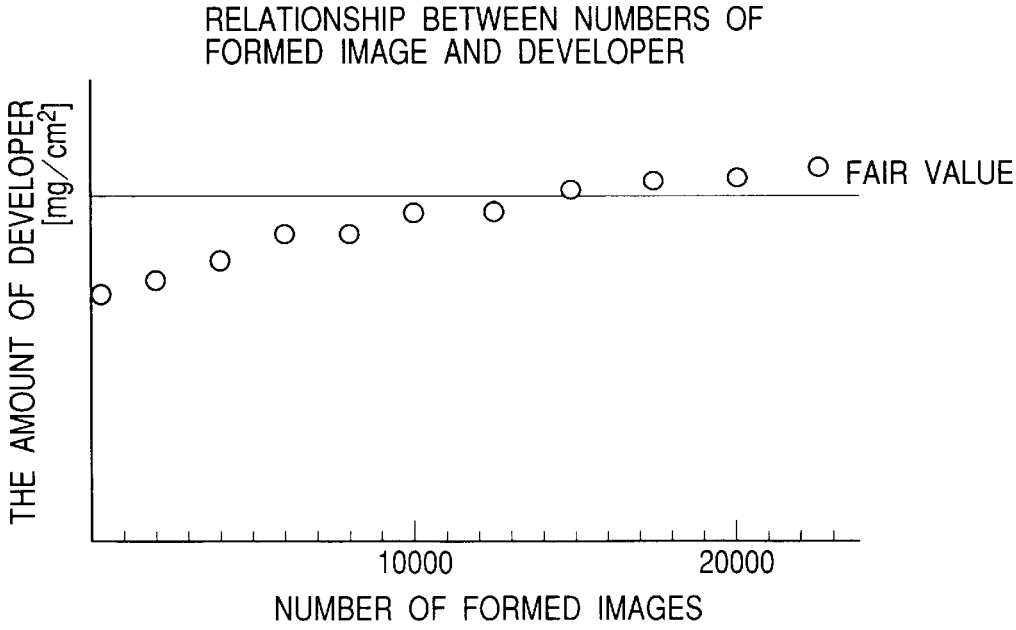
FIG. 18 shows the relationship between the number of formed images and the amount of developer in the prior art.

A fifth embodiment of the developer container, the process cartridge and the image forming apparatus according to the present invention will now be described with reference to FIG. 15. In FIG. 15 which shows the construction of the process cartridge according to the present embodiment, portions overlapping those in the above-described embodiment are given the same reference characters and need not be described.

While in the first embodiment, the partition members 18*a* and 18*b* have been shown as being formed with the openings 19, in the present embodiment, a valve mechanism 20 is provided in each opening 19. This valve mechanism 20 is comprised of a PBT (polybutylene terephthalate) sheet having a thickness of 50 $\mu$m, and serves to give directionality to the movement of the toner. That is, the toner consumed in the agitating area of the agitating member 17*a* is made up for from the area of the agitating member 17*b* to thereby prevent the counter flow to the agitating member 17*b*. Therefore, the supply of fresh toner to the developing sleeve 15 is further reduced and thus, the rising of the toner near the developing sleeve 15 and the agitating member 15*a* can be further improved.

The present invention is not restricted to the above-described embodiments, but also covers modifications identical therewith in technical idea.

What is claimed is:

1. A developing device comprising:

a developer bearing member; and a developer container for containing a developer therein, said developer container including a plurality of developer containing rooms and a plurality of developer conveyers for conveying the developer toward said developer bearing member, wherein said plurality of developer containing rooms are partitioned by plate-shaped members except for openings formed therein through which the developer passes, said openings being located so as to be buried in the developer during non-use of the developer, wherein a rotational speed of a developer conveyer, which is provided in a developer containing room nearest to said developer bearing member, is higher than a rotational speed of other developer conveyers among said plurality of developer conveyers, which are provided in other developer containing rooms among said plurality of developer containing rooms, and wherein said plurality of developer conveyers are sheet-shaped, and said developer conveyer in said developer containing room, which nearest to said developer bearing member, is thinnest among said plurality of developer containers.

2. A developing device according to claim 1, wherein bottom surfaces of said plurality of developing containing rooms are arcuate.

3. A developing device according to claim 1, wherein a volume of said developer containing room, which is nearest to said developer bearing member, is less than a volume of said other developer containing rooms.

4. A developing device according to claim 1, wherein Young's modulii of said plurality of developer conveyers are the same.

5. A developing device according to claim 1, wherein a Young's modulus of said developer conveyer, provided in said developer containing room, which is nearest to said developer bearing member, is smallest among Young's modulii of said plurality of developer conveyers.

6. A developing device according to claim 1, wherein said developer container further includes a developer containing room provided with said developer bearing member, adjacent to said developer containing room, which is nearest to said developer bearing member.

7. A developing device comprising:

a developer bearing member; and a developer container for containing a developer therein, said developer container including a plurality of developer containing rooms and a plurality of developer conveyers for conveying the developer toward said developer bearing member, wherein a volume of a developer containing room, which is nearest to said developer bearing member, is smaller than a volume of other developer containing rooms among said plurality of developer containing rooms, and wherein said plurality of developer conveyers are sheet-shaped, and a developer conveyer provided in said developer containing room, which is nearest to said developer bearing member, is thinnest among said plurality of developer conveyers.

8. A developing device according to claim 7, wherein said plurality of developer containing rooms are partitioned by plate-shaped members except for openings formed therein through which the developer passes.

9. A developing device according to claim 7, wherein bottom surfaces of said plurality of developer containing rooms are arcuate.

10. A developing device according to claim 7, wherein Young's modulii of said plurality of developer conveyers are the same.

11. A developing device according to claim 7, wherein said developer container further includes a developer containing room provided with said developer bearing member, adjacent to said developer containing room, which is nearest to said developer bearing member.

12. A developing device comprising:

a developer bearing member; and a developer container for containing a developer therein, said developer container including a plurality of developer containing rooms and a plurality of developer conveyers for conveying the developer toward said developer bearing member, wherein a volume of a developer containing room, which is nearest to said developer bearing member, is smaller than a volume of other developer containing rooms among said plurality of developer containing rooms, and wherein said plurality of developer conveyers are sheet-shaped, and a Young's modulus of a developer conveyer provided in said developer containing room, which is nearest to said developer bearing member, is smallest among the Young's modulii of said developer conveyers.

13. A developing device comprising:

a developer bearing member; and a developer container for containing a developer therein, said developer container including a plurality of developer containing rooms and a plurality of sheet-shaped developer conveyers for conveying the developer toward said developer bearing member, wherein a thickness of said developer conveyer provided in said developer containing room, which is nearest to said developer bearing member, is less than a thickness of other developer conveyers among said plurality of developer conveyer members.

14. A developing device according to claim 13, wherein said plurality of developer containing rooms are partitioned by plate-shaped members except for openings formed therein through which the developer passes.

15. A developing device according to claim 13, wherein bottom surfaces of said plurality of developer containing rooms are arcuate.

16. A developing device according to claim 13, wherein Young's modulii of said plurality of developer conveyers are the same.

17. A developing device according to claim 13, wherein a Young's modulus of said developer conveyer provided in said developer containing room, which is nearest to said developer bearing member, is smallest among the Young's modulii of said plurality of developer conveyers.

18. A developing device according to claim 13, wherein said developer container further includes a developer containing room provided with said developer bearing member, which is adjacent to said developer containing room, which is nearest to said developer bearing member.

19. A developing device comprising:

a developer bearing member; and a developer container for containing a developer therein, said developer container including a plurality of developer containing rooms and a plurality of sheet-shaped developer conveyers for conveying the developer toward said developer bearing member, wherein a Young's modulus of a developer conveyer provided in a developer containing room, which is nearest to said developer bearing member, is smaller than a Young's modulus of other developer conveyers among said plurality of developer conveyer members.

20. A developing device according to claim 19, wherein said plurality of developer containing rooms are partitioned by plate-shaped members except for openings formed therein through which the developer passes.

21. A developing device according to claim 19, wherein bottom surfaces of said plurality of developer containing rooms are arcuate.

22. A developing device according to claim 19, wherein said developer container further includes a developer containing room provided with said developer bearing member, which is adjacent to said developer containing room, which is nearest to said developer bearing member.

23. A developing device according to any one of claims 1, 7, 12, 13, and 19, which is detachably mountable on an image forming apparatus.

* * * * *

UNITED STATES PATENT AND TRADEMARK OFFICE

CERTIFICATE OF CORRECTION

PATENT NO. : 6,766,132 B2
DATED : July 20, 2004
INVENTOR(S) : Hiroaki Sakai et al.

It is certified that error appears in the above-identified patent and that said Letters Patent is hereby corrected as shown below:

Drawings,
Sheet 7, Figure 11, “DEFERENCE” should read -- DIFFERENCE --.

Column 2,
Lines 42, 54 and 67, “member;”, should read -- member, --;
Line 59, “a further” should read -- A further --.

Column 4,
Line 64, “surfaced” should read -- surface --.

Column 7,
Line 43, “(●X)” should read -- (●:X) --.

Column 10,
Line 8, “nearest” should read -- is nearest --;
Lines 19 and 56, “modulii” should read -- moduli --;
Line 25, “ulii” should read -- uli --; and Column 11,
Lines 13 and 36, “modulii” should read -- moduli --; and Column 12,
Line 3, “modulii” should read -- moduli --.

Signed and Sealed this

Fifth Day of October, 2004

JON W. DUDAS
*Director of the United States Patent and Trademark Office*